US007273061B2

(12) United States Patent
Choi

(10) Patent No.: US 7,273,061 B2
(45) Date of Patent: Sep. 25, 2007

(54) WATERPROOF STRUCTURE OF TENT POLE-HOLDING TAPE

(76) Inventor: Kyong Jai Choi, 312-301 Beach Apt., 29/5, 148 Namcheon-Dong, Suyoung-Ku, Pusan (KR) 613-101

( * ) Notice: Subject to any disclaimer, the term of this patent is extended or adjusted under 35 U.S.C. 154(b) by 168 days.

(21) Appl. No.: 10/799,883

(22) Filed: Mar. 15, 2004

(65) Prior Publication Data

US 2005/0172989 A1 Aug. 11, 2005

(30) Foreign Application Priority Data

Feb. 9, 2004 (KR) ..... 10-2004-0008475

(51) Int. Cl.
*E04H 15/64* (2006.01)

(52) U.S. Cl. ..... 135/119

(58) Field of Classification Search ..... 135/114–115, 135/119, 135–137, 157, 124, 132; 160/389, 160/400, 371; 24/442, 306; 2/275; 112/441
See application file for complete search history.

(56) References Cited

U.S. PATENT DOCUMENTS

| | | | | |
|---|---|---|---|---|
| 2,988,457 | A * | 6/1961 | Gatcomb | 442/67 |
| 4,102,352 | A * | 7/1978 | Kirkham | 135/97 |
| 4,269,210 | A * | 5/1981 | Marks | 135/125 |
| 4,483,019 | A * | 11/1984 | Spangrud et al. | 2/2.16 |
| 4,593,418 | A * | 6/1986 | Simon | 2/275 |
| 4,759,963 | A * | 7/1988 | Uso et al. | 428/100 |
| 5,040,557 | A * | 8/1991 | Morgan | 135/88.05 |
| 5,067,505 | A * | 11/1991 | Cantwell et al. | 135/125 |
| 5,353,826 | A * | 10/1994 | Davis, Sr. | 135/88.13 |
| 5,398,678 | A * | 3/1995 | Gamow | 128/205.26 |
| 5,421,355 | A * | 6/1995 | Cantwell | 135/120.3 |
| 5,444,898 | A * | 8/1995 | Norvell | 24/389 |
| 5,529,823 | A * | 6/1996 | Aumann | 428/53 |
| 5,603,591 | A * | 2/1997 | McLellan | 410/97 |
| 5,820,189 | A * | 10/1998 | Tew | 296/26.11 |
| 5,885,679 | A * | 3/1999 | Yasue et al. | 428/57 |
| 6,338,356 | B1 * | 1/2002 | Wallenstatter | 135/100 |
| 6,364,980 | B1 * | 4/2002 | Smith et al. | 156/108 |
| 6,543,465 | B2 * | 4/2003 | Choi | 135/120.1 |
| 6,606,768 | B2 * | 8/2003 | Henry et al. | 24/306 |
| 6,679,277 | B2 * | 1/2004 | Choi | 135/93 |
| 6,681,785 | B2 * | 1/2004 | Choi | 135/115 |
| 2003/0178055 | A1 * | 9/2003 | Laakso et al. | 135/119 |

FOREIGN PATENT DOCUMENTS

| | | | |
|---|---|---|---|
| FR | 2758692 | A1 * | 7/1998 |
| GB | 2031107 | A * | 4/1980 |
| JP | 61-47867 | A * | 3/1986 |

* cited by examiner

*Primary Examiner*—David Dunn
*Assistant Examiner*—Danielle Jackson
(74) *Attorney, Agent, or Firm*—Lowe Hauptman Ham & Berner LLP

(57) ABSTRACT

The waterproof structure of the tent pole-holding tape according to the present invention comprises a waterproof-coated member 111, which is fixed by a sewing line 131 to the corner portion of the tent fabric 101, and in which the front of the sewing line 131 is coated by a front waterproof tape 112, and both ends are attached to the first pole-holding tape 121 and the second pole-holding tape 122; and a side waterproof tape 113, which is attached to the outer surface of a plurality of sewing lines 131 arranged between the back surface of the waterproof-coated member 111 and the inner surface of the tent fabric 101.

1 Claim, 5 Drawing Sheets

PRIOR ART

PRIOR ART

PRIOR ART

WATERPROOF STRUCTURE OF TENT POLE-HOLDING TAPE

BACKGROUND OF THE INVENTION

1. Field of the Invention

The present invention relates to the tent, more specifically to a waterproof structure of a tent pole-holding tape that can prevent rainwater or moisture from flowing into the tent from outside through the parts of a plurality of first and second pole-holding tapes that are attached to the corner portions of the tent fabric by a sewing line fix poles to the tent fabric, by attaching a waterproof-coated member to the corner portion of the tent fabric by a sewing line, by attaching a front waterproof tape to the front of the sewing line, and by attaching both ends of the waterproof-coated member to the first pole-holding tape and the second pole-holding tape, as well as by attaching a side waterproof tape to the outer side of a plurality of sewing lines arranged between the back surface of the waterproof-coated member and the inner surface of the tent fabric.

2. Description of the Related Art

In general, poles are inserted in corner portions of the tent to pull the tent fabric in many directions by the elasticity of the pole so as to maintain the form of the tent. At this time, to fix the poles to the tent fabric, a plurality of pole-holding means composed of first and second pole-holding tapes are attached to the corner portions of the tent fabric by a sewing line.

FIGS. 1 to 3 show first and second pole-holding tapes 11 and 12 that are placed in corner portions of a conventional tent.

These first and second pole-holding tapes 11 and 12 play a role of maintaining the set-up state of the tent fabric 1 more stably by supporting pole 2 partly in close contact with the tent fabric 1.

That is, to set up one tent, a plurality of poles 2 are connected and bent to make the frame of the tent. At this time, it is these first and second pole-holding tapes 11 and 12 that play a role of fixing the pole 2 immovable to the tent fabric 1.

Therefore, since the first and second pole-holding tapes 11 and 12 play the role of fixing the pole 2, which forms the frame of the tent, to the strategic points of the tent fabric 1, it is possible to set up the tent more firmly.

Commonly, for the sake of the convenience of use, the first and second pole-holding tapes 11 and 12 are equipped with an adhesion means such as Velcro Fastener™, which is possible to attach and detach many times repeatedly. The first pole-holding tape 121 may comprise a female fastener, and the second holding tape 122 may comprise a male fastener, or vice versa.

But the conventional first and second pole-holding tapes 11 and 12 are, as shown in FIG. 3, sewn to the tent fabric 1 by the sewing line 21, and on the front of this sewing line 21 is attached a front waterproof tape 3. The front waterproof tape 3 plays a role as a waterproof means of intercepting the inflow of rainwater and moisture from outside through the sewing line 21.

However, the problem is that although it is possible to prevent outside rainwater or moisture from penetrating into the front of the tent attached with the front waterproof tape 3, it is not possible to intercept the inflow of rainwater or moisture penetrating into the tent, as shown by the arrow in FIG. 3, through both sides of the sewing line 21, which is between the back surface of the first and second pole-holding tapes 11 and the inner surface of the tent fabric 1.

Especially, since it is not possible to coat the first and second pole-holding tapes 11 and 12, it not possible to attach waterproof tapes, either.

Therefore, it is not possible to intercept rainwater and moisture flowing into the tent through both sides of the sewing line 21.

SUMMARY OF THE INVENTION

The present invention is designed in consideration of the problems of the prior art, and therefore it is an object of the present invention to provide a waterproof structure of the pole-holding tape of the tent that can prevent the inflow of rainwater or moisture from outside through the sewing line located between the back surface of the first and second pole-holding tapes and the inner surface of the tent fabric.

In accordance with the present invention, there is provided a pole-holding tape of the tent having first and second holding tapes that are fixed by a plurality of sewing lines to the corner portion of tent fabric where the pole is located and fix the pole to the tent fabric while shielding the outer circumferential surface of the pole, comprising: a waterproof-coated member, which is fixed by a sewing line to the corner portion of said tent fabric and in which the front of said sewing line is treated waterproof by a front waterproof tape, and both ends are attached to said first pole-holding tape and second pole-holding tape; and a side waterproof tape which is attached to the outer side of a plurality of sewing lines arranged between the back surface of the waterproof-coated member and the inner surface of the tent fabric.

BRIEF DESCRIPTION OF DRAWINGS

Other objects and aspects of the present invention will become apparent from the following description of embodiments with reference to the accompanying drawings in which.

DESCRIPTION OF THE PREFERRED EMBODIMENT

Figure 1:
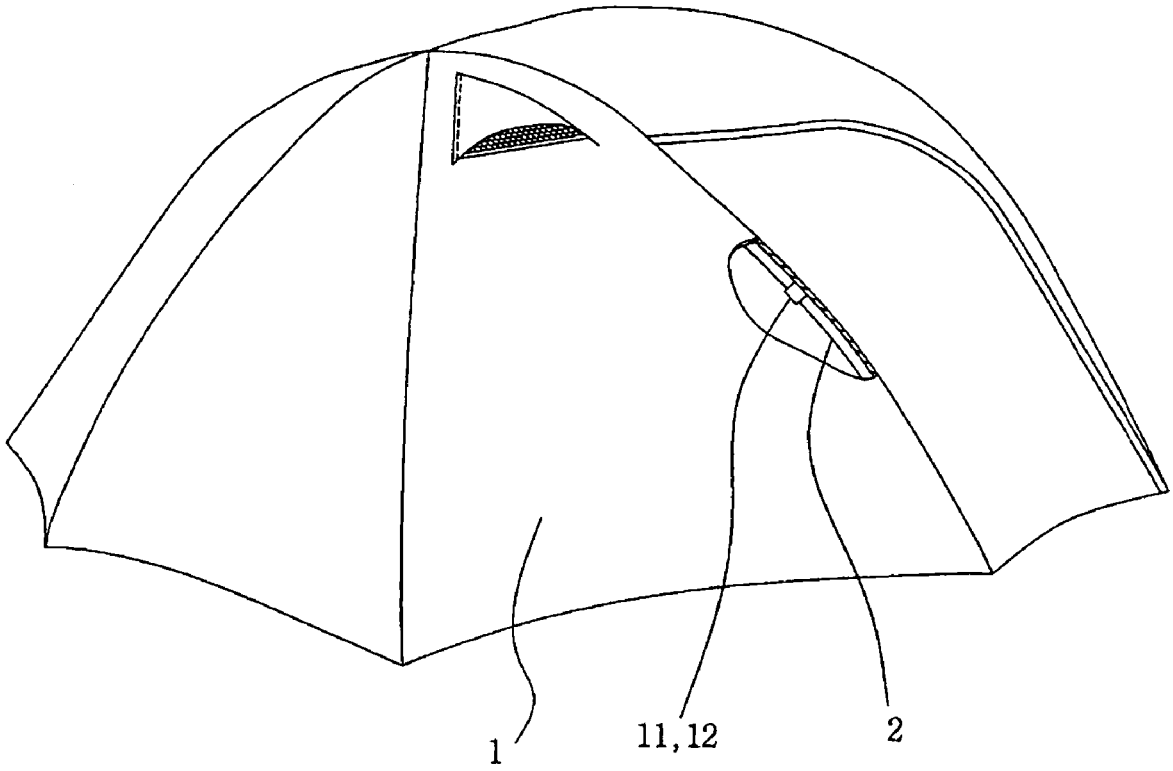
FIG. 1 is a perspective view showing a pole-holding tape sewn to the inside of a conventional tent fabric.
Figure 2:
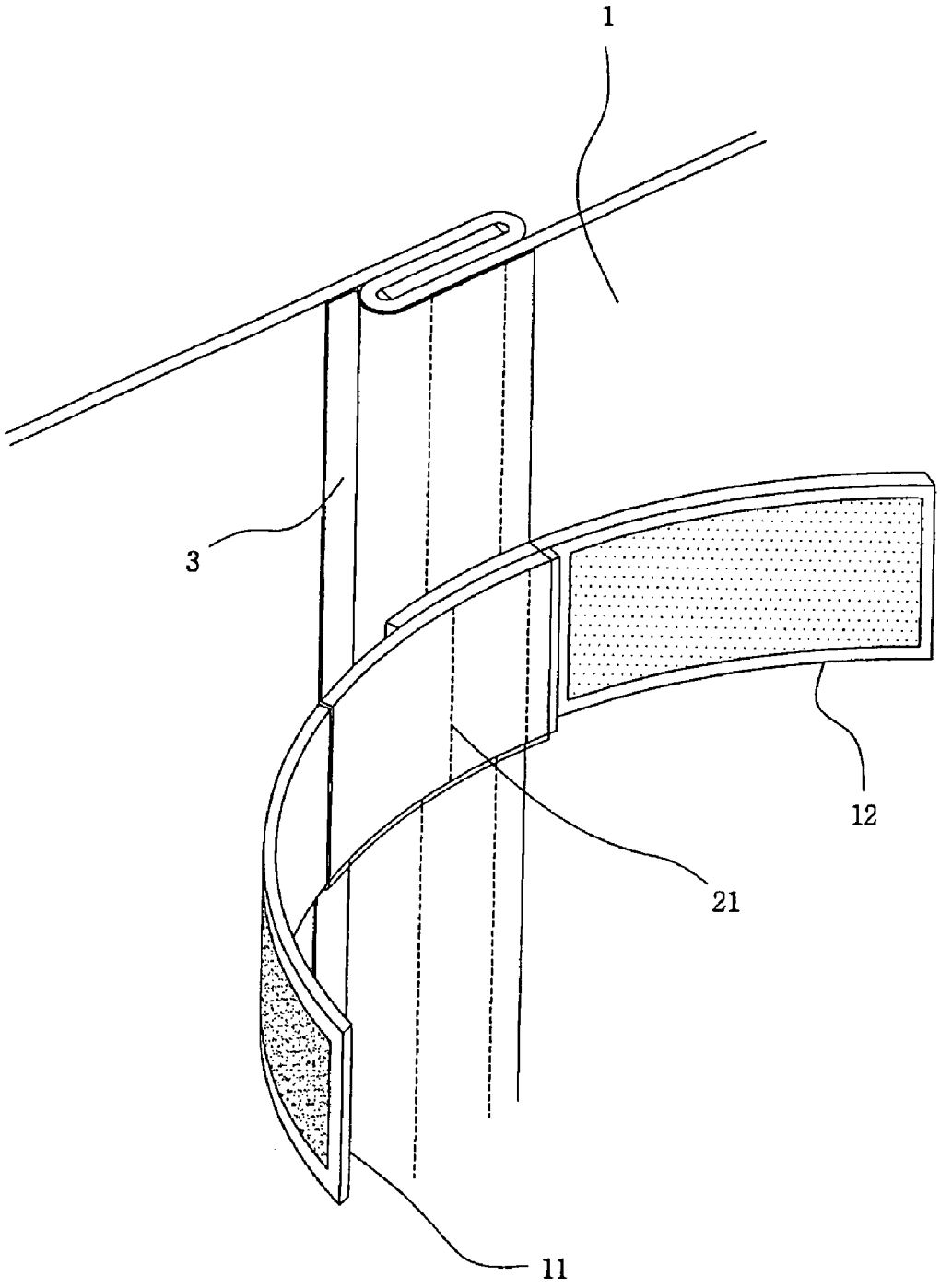
FIG. 2 is an enlarged perspective view showing the pole-holding tape sewn to the conventional tent fabric.
Figure 3:
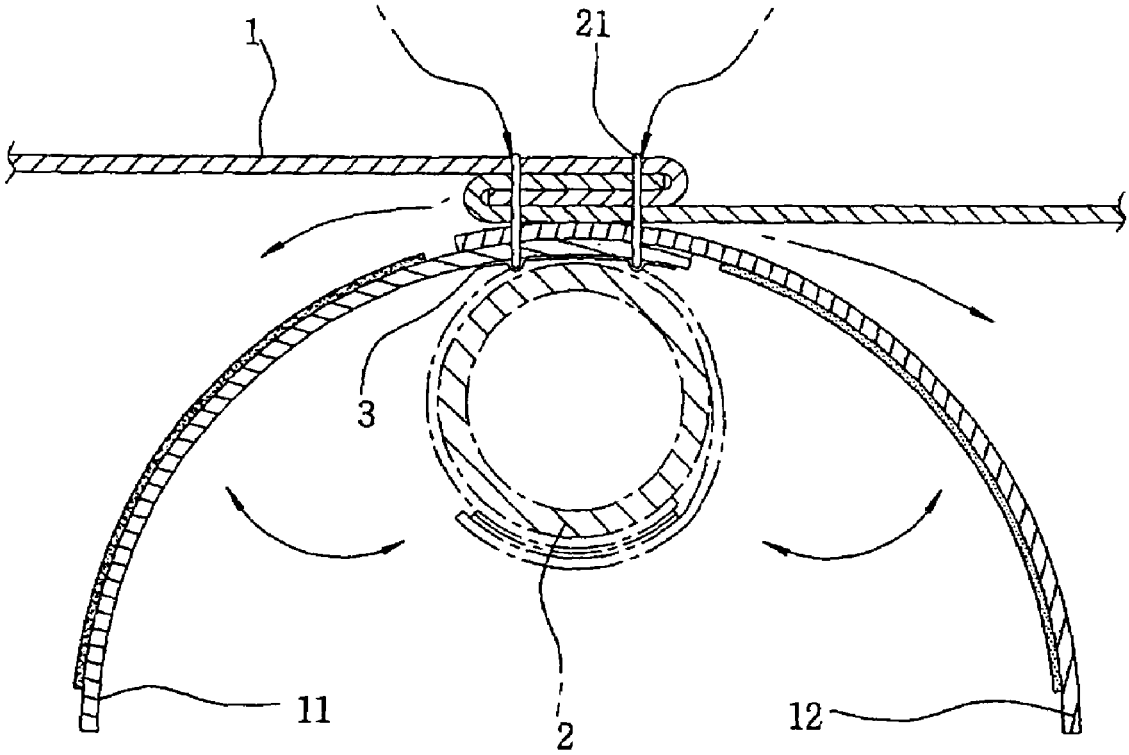
FIG. 3 is a schematic cross-sectional view for describing the water leakage originated from sewing the pole-holding tape to the conventional tent fabric.

Hereinafter, the present invention will be described in more detail referring to the drawings.

The present invention shows a waterproof structure of a tent pole-holding tape that has first and second pole-holding tapes 121 and 122, which are fixed by a plurality of sewing lines 131 to the corner portion of the tent fabric 101 where the pole 102 is located and fix the pole 102 to the tent fabric 101 while shielding the outer circumferential surface of the pole 102.

The waterproof structure of the tent pole-holding tape according to the present invention comprises a waterproof-coated member 111, which is fixed by a sewing line 131 to the corner portion of the tent fabric 101, and in which the front of the sewing line 131 is coated by a front waterproof tape 112, and both ends are attached to the first pole-holding tape 121 and the second pole-holding tape 122; and a side waterproof tape 113, which is attached to the outer surface of a plurality of sewing lines 131 arranged between the back surface of the waterproof-coated member 111 and the inner surface of the tent fabric 101.

As described above, for the sake of the convenience of use, the first and second pole-holding tapes 121 and 122 are equipped with an adhesion means such as Velcro Fastener™, which is possible to attach and detach many times repeatedly. The first pole-holding tape 121 may comprise a female fastener, and the second holding tape 122 may comprise a male fastener, or vice versa.

Here, the waterproof-coated member 111 is attached by sewing line 131 to the corner portion of the tent fabric 101, and the front is attached with a front waterproof tape 112 to make waterproof treatment of the front of the sewing line 131. The ends of the waterproof-coated member 111 are attached by the sewing line 131 respectively to the first pole-holding tape 121 and the second pole-holding tape 122.

There is a fear that rainwater or moisture could flow in from outside through the outer surface of a plurality (two in the present embodiment) of sewing lines 131 arranged between the back surface of the waterproof-coated member 111 and the inner surface of the tent fabric 101. To prevent this, attach a side waterproof tape 113 to the outer surface of the sewing line 131 between the back surface of the waterproof-coated member 111 and the inner surface of the tent fabric 101.

Next will be described the manufacturing process and the principle of operation of the present invention having such a configuration.

Figure 4:
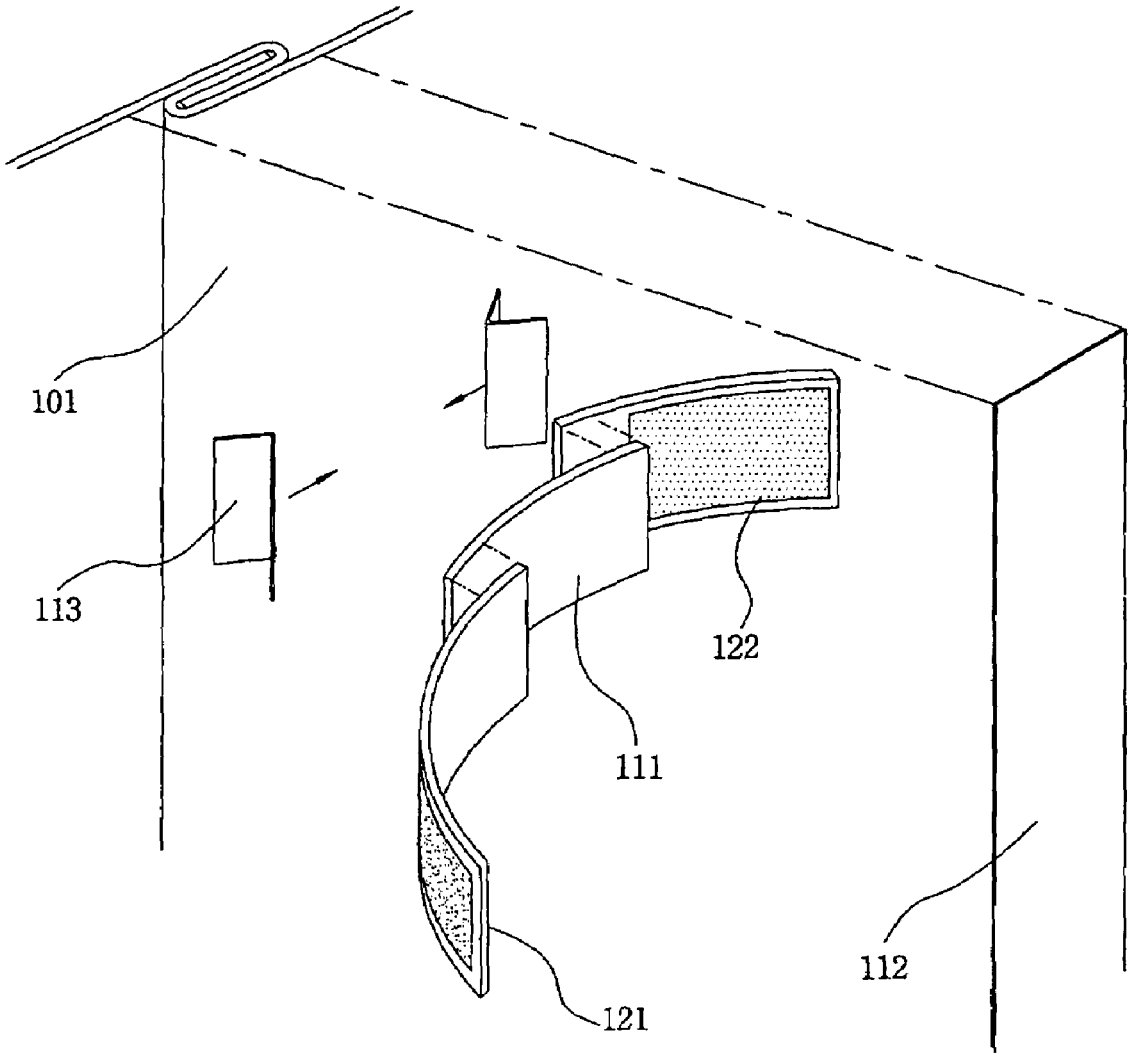
FIG. 4 is a perspective view for describing the sewing process of a waterproof-coated member according to the present invention.

First, as shown in FIG. 4, sew and attach the first pole-holding tape 121 and the second pole-holding tape 122 respectively to the ends of the waterproof-coated member 111.

Next, contact the central portion of the waterproof-coated member 111, which has the first and second pole-holding tapes 121 and 122 attached, with the overlapped portion of the tent fabric 101, which has two fabrics overlapped, and then attach the two by two sewing lines 131.

Like this, after attaching the waterproof-coated member 111 to the tent fabric 101, attach the front waterproof tape 112 to the sewing line 131 exposed to the front to make waterproof treatment of the front of the sewing line 131.

Figure 5:
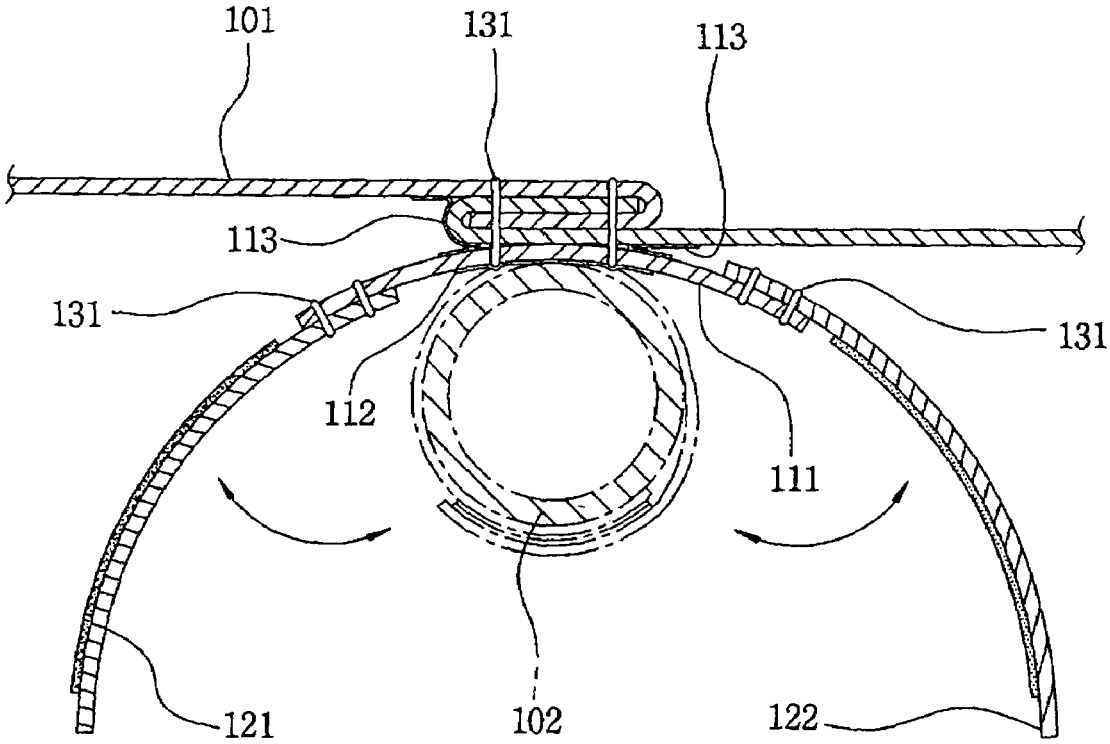
FIG. 5 is a schematic perspective view for describing the waterproofing action by the waterproof-coated member of the tent according to the present invention.

And, attach a side waterproof tape 113, as shown in FIG. 5, to both outer sides of the sewing line 131 which is arranged between the back surface of the waterproof-coated member 111 and the inner surface of the tent fabric 101.

Accordingly, it is possible to waterproof by the side waterproof tape 113 the outer side part of the sewing line 131, which is the back surface of the first pole-holding tape 121 and the second pole-holding tape, and waterproof the front of the sewing line by the front waterproof tape 112, so we can obtain a perfect waterproof structure.

As mentioned above, the present invention can provide a more comfortable and stable tent, since it is possible to prevent outside rainwater or moisture from flowing in through both sides of the sewing line between the back surface of the first and second pole-holding tapes and the inner surface of the tent fabric.

What is claimed is:

1. A pole-holding tape of a tent having first and second holding tapes that are fixed by a plurality of sewing lines to a corner portion of tent fabric where a pole is located to secure the tent fabric to the pole, the pole-holding tape shielding the outer circumferential surface of the pole, the pole-holding tape comprising:

a waterproof-coated member, which is fixed by a sewing line to the corner portion of said tent fabric and in which the front of said sewing line is covered by a front waterproof tape, and both ends of said waterproof-coated member being attached to said first pole-holding tape and said second pole-holding tape; and a side waterproof tape which is attached to the outer side of a plurality of sewing lines arranged between the back surface of the waterproof-coated member and the inner surface of the tent fabric.

* * * * *